United States Patent [19]

Degenholtz

[11] Patent Number: 4,722,504

[45] Date of Patent: Feb. 2, 1988

[54] FOLDING COMPUTER DOCUMENTATION STAND

[76] Inventor: Howard B. Degenholtz, 32 Vandelinda Ave., Teaneck, N.J. 07666

[21] Appl. No.: 815,730

[22] Filed: Jan. 2, 1986

[51] Int. Cl.[4] ..... A47B 97/08

[52] U.S. Cl. ..... 248/459; 248/174; 248/460

[58] Field of Search ..... 248/459, 460, 465, 174

[56] References Cited

U.S. PATENT DOCUMENTS

| | | | |
|---|---|---|---|
| 2,035,021 | 3/1936 | Pyle et al. | 248/174 |
| 2,165,255 | 7/1939 | Hamilton | 248/459 X |
| 2,726,835 | 12/1955 | Hummel | 248/459 |
| 3,195,850 | 7/1965 | Steiner | 248/459 X |
| 3,410,516 | 11/1968 | Criswell | 248/459 |
| 3,438,508 | 4/1969 | Kuns et al. | 248/174 X |
| 4,105,182 | 8/1978 | Jacobsen | 248/174 X |
| 4,318,471 | 3/1982 | Hutton | 248/459 X |

FOREIGN PATENT DOCUMENTS

| | | | |
|---|---|---|---|
| 1561778 | 3/1980 | United Kingdom | 248/459 |

*Primary Examiner*—J. Franklin Foss
*Assistant Examiner*—David L. Talbott
*Attorney, Agent, or Firm*—Arthur I. Degenholtz

[57] ABSTRACT

A folding computer documentation stand is provided which is formed of hinged panels. The panels are maintained in an erect configuration by means of intergaging notched portions and form a support for the back of a document and a stop for the bottom of the document thereby enabling the apparatus to maintain the document in a position which is comfortable for a reader while using a computer keyboard. The apparatus may be folded to conform with the overall size of a conventional five and one-quarter inch floppy disk, thereby facilitating storage.

3 Claims, 11 Drawing Figures

FOLDING COMPUTER DOCUMENTATION STAND

BACKGROUND OF THE INVENTION

With the ever increasing use of computers in almost every field of industrial and academic activity, there has come a need for an effective stand to support books and other documentation used with computers. The need exists for a documentation stand which is sufficiently large and sturdy to conveniently support relatively heavy fan fold printouts which are commonly 11 by 15 inches as well as text books, computer program documentation and computer magazines. Because space is at a premium in industrial offices as well as in academic areas it is especially desirable for a computer documentation stand to be both light in weight and foldable for purposes of portability and ease of storage. Since a high percentage of present computers use a five and one-quarter inch flexible magnetic storage disk commonly known as a floppy disk as a storage medium, it is especially useful for a computer documentation stand to be capable of being folded into a size which is compatible with the size of a floppy disk for ease of transportation and storage.

OBJECTS OF THE INVENTION

It is a primary object of the invention to provide a folding computer documentation stand which can support computer printouts, books or magazines in a convenient reading position for use in conjunction with a computer keyboard.

Another object of the invention is to provide a folding computer documentation stand which is both light in weight and rigid in configuration.

Another object of the invention is to provide a folding computer documentation stand which may be folded into a square configuration not exceeding five and one-quarter inches on a side, thereby facilitating storage and transportation of the device along with standard five and one-quarter inch floppy disks.

Another object of the invention is to provide a folding computer documentation stand which may be quickly and easily folded and unfolded facilitating transportation of the device between different areas.

Still another object of the invention is to provide a folding computer documentation stand which comprises a single unitary member and which is economical of manufacture.

SUMMARY OF THE INVENTION

In accordance with the present invention, there is provided a folding computer documention stand which comprises a plurality of relatively thin rigid panels which are connected by hinge portions and intergaging notched portions to form a rigid support for the back of a document and a rigid stop for the bottom of the document. The apparatus is formed as a unitary member with the hinge portions being formed as portions of reduced cross-sectional area. The maximum size of each of the panels is approximately five inches and the apparatus can be folded so that it does not extend beyond the height and width of a standard five and one-quarter inch floppy disk.

BRIEF DESCRIPTION OF THE DRAWINGS

Additional objects and advantages of the invention will become apparent during the course of the following specification, when taken in connection with the drawings in which.

DETAILED DESCRIPTION OF THE INVENTION

Figure 1:
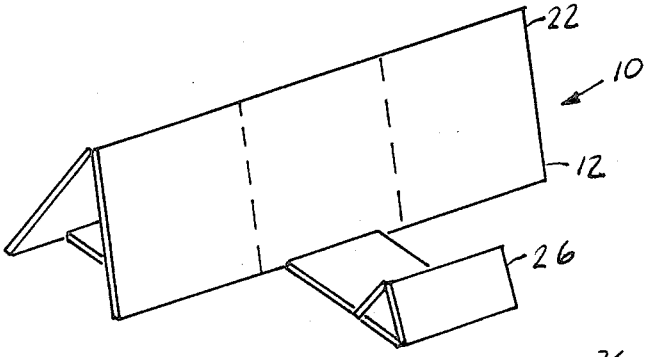
FIG. 1 is an overall perspective view of a folding computer documentation stand made in accordance with the present invention.
Figure 3:
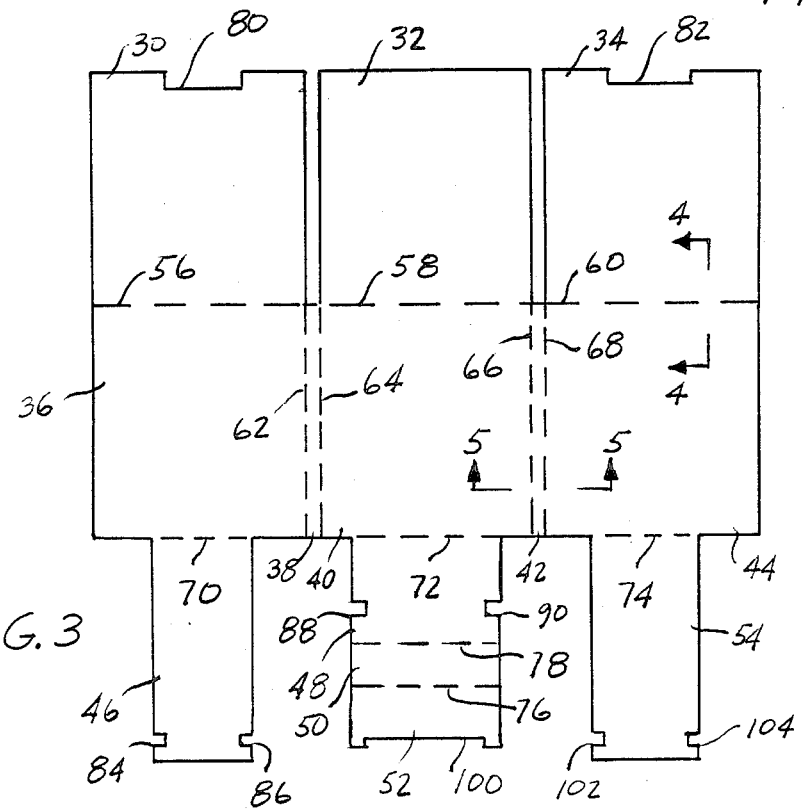
FIG. 3 is a plan view of the folding computer documentation stand of FIG. 1 with the apparatus shown unfolded.

With reference to the drawings there is shown in FIG. 1 an overall view of a folding computer documentation stand 10 made in accordance with the present invention comprising a single unitary member 12 which is best shown in FIG. 3.

Figure 2:
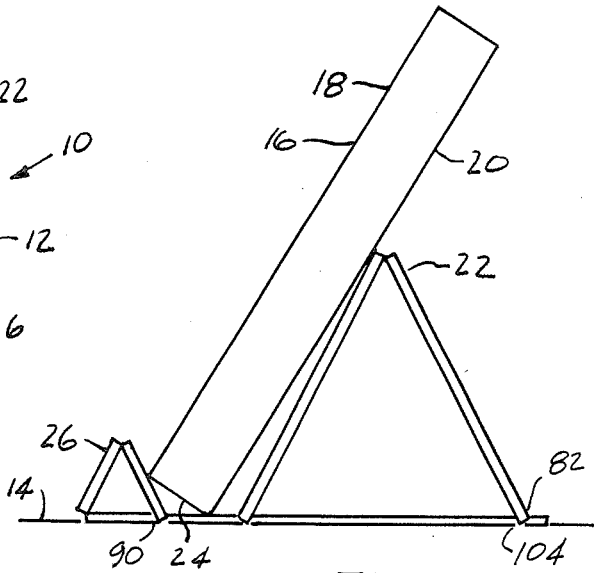
FIG. 2 is a side elevation view of the folding computer documentation stand of FIG. 1 with the apparatus shown in use resting on a table top and supporting a document.

FIG. 2 shows the apparatus according to the present invention, in use, resting on a table top 14 and supporting a book 16 which is represented by the rectangle 18. The back 20 of the book 16 rests against the support portion 22 and the bottom 24 of the book 16 is restrained by the stop portion 26.

As is best shown in FIGS. 1, 2 and 3, the folding computer documentation stand 10 comprises a plurality of panels 30, 32, 34, 36, 38, 40, 42, 44, 46 48, 50, 52, 54 which are connected by hinge portions 56, 58, 60, 62, 64, 66, 68, 70, 72, 74 76, 78. The hinge portions are represented diagrammatically in FIGS. 1 and 3 by means of broken lines for purposes of clarity of illustration.

Figure 4:
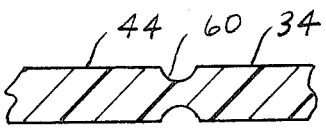
FIG. 4 is a cross-sectional view taken along the line 4—4 of FIG. 3 drawn to an enlarged scale.
Figure 5:
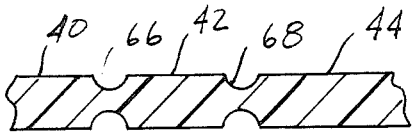
FIG. 5 is a cross-sectional view taken along the line 5—5 of FIG. 3 drawn to an enlarged scale.

The type of hinge shown in FIGS. 1 and 3 is shown in cross section in FIGS. 4 and 5 as having an area of reduced thickness. This type of hinge is well known in the field of plastic manufacture and therefore need not be further described.

The hinges 66,68 shown in FIG. 5 are each identical to the hinge 60 shown in FIG. 4 with the exception that between the hinges 66,68 there is a relatively narrow panel 142.

With reference to FIG. 3, the various panels are connected by hinges in the following manner: Panel 30 is connected to panel 36 by means of hinge 56. Panel 32 is connected to panel 40 by means of hinge 58. Panel 34 is connected to panel 44 by means of hinge 60. Panel 36 is connected to panel 38 by means of hinge 62. Panel 38 is connected to panel 40 by means of hinge 64. Panel 40 is connected to panel 42 by means of hinge 66. Panel 42 is connected to panel 44 by means of hinge 68. Panel 36 is connected to panel 46 by means of hinge 70. Panel 40 is connected to panel 48 by means of hinge 72. Panel 48 is connected to panel 50 by means of hinge 78. Panel 50 is connected to panel 52 by means of hinge 76. Panel 44 is connected to panel 54 by means of hinge 74.

In addition, the following notched portions are provided on the following panels: Notched portion 80 is formed on panel 30. Notched portion 82 is formed on panel 34. Notched portions 84,86 are formed on panel 46. Notched portions 88,90 are formed on panel 48. Notched portion 100 is formed on panel 52. Notched portions 102,104 are formed on panel 54.

In use, the hinges 56, 58 and 60 are folded with the notched portions 84, 86 engaging the notched portion 80 and the notched portions 102, 104 engaging the notched portion 82 as shown in FIGS. 1 and 2. In addition, the panels 48, 50 and 52 are folded to form the stop 26 with the notched portions 88 and 90 engaging the notched portions 100. The engagement of the various notched portions results in the rigid structure shown in FIGS. 1 and 2 which is capable of supporting relatively heavy books or computer documents.

Figure 6:
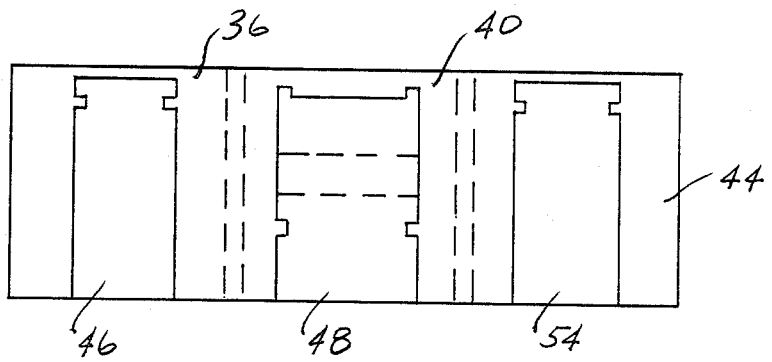
FIG. 6 is a plan view of the apparatus of FIG. 1 showing the apparatus partially folded.
Figure 7:
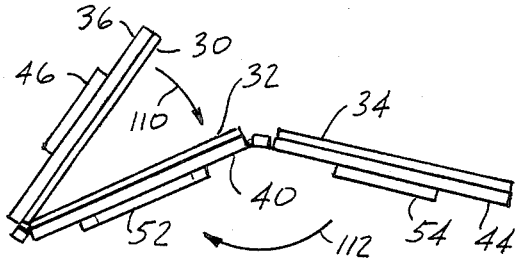
FIG. 7 is a top view showing a subsequent step in the folding of the apparatus of FIG. 1.
Figure 8:
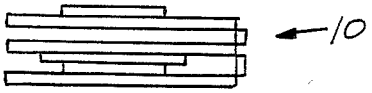
FIG. 8 is a side view showing the apparatus of FIG. 1 in a folded state.

When the folding computer documentation stand 10 is no longer being used, it may be folded by first disengaging all of the engaged notched portions and placing all of the panels flat as is shown in FIG. 3. The panels 30, 32 and 34 are folded against the panels 36, 40 and 44 respectively. The panels 46 and 54 are folded against the panels 36 and 44 respectively, and the panels 48, 50 and 52 are folded against the panel 40 as is shown in FIG. 6. The panel 30 is then folded against the panel 32 as is indicated by the arrow 110 in FIG. 7 and the panel 44 is folded against the panel 40 as indicated by the arrow 112 also in FIG. 7. FIG. 8 shows the completely folded apparatus 10 forming a compact configuration.

Figure 9:
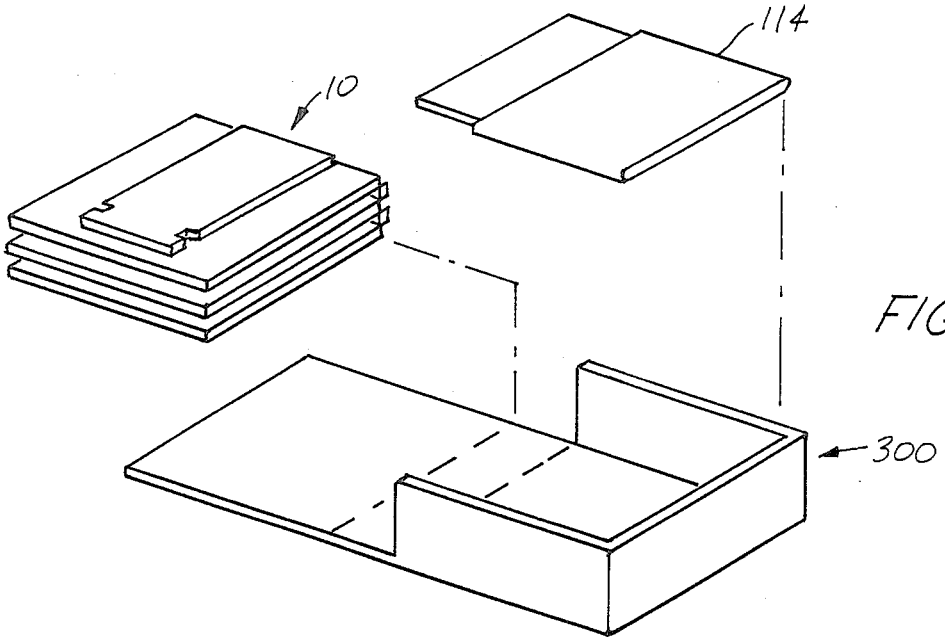
FIG. 9 is an exploded view showing the apparatus of FIG. 1 being stored with a floppy disk in a storage container.

Each of the panels 30, 32, 34, 36, 40 and 44 is preferably square in overall configuration with a preferred dimension of approximately five inches on a side so that the folded apparatus 10 has a maximum size which is less than five and one-quarter inches by five and one-quarater inches. These preferred proportions enable the apparatus 10 to be stacked conveniently with five and one quarter inch flexible computer storage disks 114 and carried in a conventional disk storage box 300 as is shown in FIG. 9. Despite the relatively small size of the individual panels, the apparatus 10 is capable of supporting relatively large books and heavy computer printouts and documentation and holding these documents in an upright manner which makes it convenient for a user to read from these documents while operating a computer.

Figure 10:
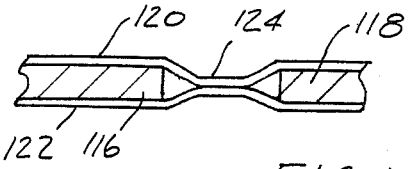
FIG. 10 is a cross-sectional view similar to FIG. 4 showing an alternative method of construction.

FIG. 10 shows an alternative method of construction of the apparatus according to the present invention. In this method of construction, the previously described panels are made of stiff cardboard, such as illustration board, and the panels 116, 118 are covered with a heat-sealable plastic film 120, 122 such as vinyl. Hinges are formed in accordance with the previously described configuration of FIG. 3 by forming a heat sealed portion 124 between the panels 116, 118, as is shown in FIG. 10. The edges of the plastic film 120, 122 are heat-sealed in a conventional manner, which is not illustrated, thereby completely covering the panels 116, 118.

Figure 11:
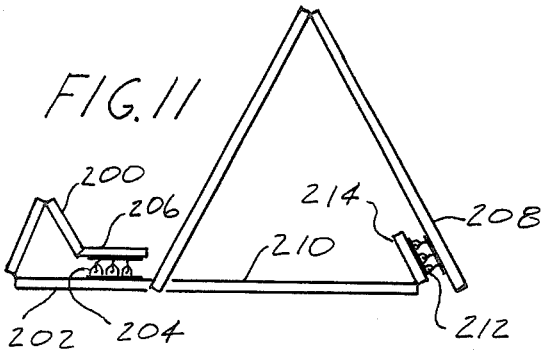
FIG. 11 is a side view showing another alternative method of construction.

FIG. 11 shows another alternative method of construction of the apparatus according to the invention in which hook and eye fasteners of type known under the trade name VELCRO are used in lieu of the previously described notched portions. The panel 200 is removeably connected to an intermediate portion of the panel 202 by means of a hook and eye fastener assembly 204 which is attached to the panels 202, 206. The panel 208 is removeably connected to the panel 210 by means of a similar hook and eye fastener assembly 212 which is connected to the panels 214, 208. The panels 206, 214 are hingedly connected to panels 200, 208, respectively, in the manner previously described.

While preferred embodiments of the invention have been shown and described herein, it is obvious that numerous additions, changes and omissions may be made in such embodiments without departing from the spirit and scope of the invention.

What is claimed is:

1. A folding computer documentation stand for supporting a document in an upright position comprising, support means for supporting the back of said document and stop means for restraining the bottom of said document, with said support means comprising a plurality of panels for the purpose of assembling said support means and with said stop means comprising a plurality of panels, hinge means connecting said panels and connection means disposed on said panels for the purpose of assembling said stop means and, with said support means and said stop means comprising a unitary member, with said support means comprising six panels, and in which said six panels are arranged as two rows of three panels each and when assembled said support means comprises two wall portions forming an acute angle with each wall portion comprising a row of three panels.

2. A folding computer documentation stand according to claim 1 further comprising at least one restraint panel means hingedly connected to one of said panels and removeably connected to an opposite panel for the purpose of causing said opposite panels to form an acute angle.

3. A folding computer documentation stand according to claim 1 in which said hinge means include a first plurality of hinge means disposed parallel to each other and a second plurality of hinge means disposed perpendicularly to said first plurality of hinges.

* * * * *